US008841247B2

(12) United States Patent
Miracle et al.

(10) Patent No.: US 8,841,247 B2
(45) Date of Patent: Sep. 23, 2014

(54) DETERGENT COMPOSITIONS CONTAINING PYRIDINOL-N-OXIDE COMPOSITIONS

(75) Inventors: Gregory Scot Miracle, Liberty Township, OH (US); Bruce Prentiss Murch, Cincinnati, OH (US); Patrick Christopher Stenger, Fairfield, OH (US); Charles Allen Pettigrew, Jr., West Chester, OH (US); Justin Angelo Caserta, Mason, OH (US); Casey Patrick Kelly, Wyoming, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/586,445

(22) Filed: Aug. 15, 2012

(65) Prior Publication Data

US 2013/0045910 A1 Feb. 21, 2013

Related U.S. Application Data

(60) Provisional application No. 61/523,444, filed on Aug. 15, 2011.

(51) Int. Cl.

| | |
|---|---|
| ***C11D 1/02*** | (2006.01) |
| ***C11D 1/66*** | (2006.01) |
| ***C11D 1/83*** | (2006.01) |
| ***C11D 3/28*** | (2006.01) |
| ***C11D 3/20*** | (2006.01) |
| ***C11D 3/04*** | (2006.01) |
| ***C11D 3/12*** | (2006.01) |
| ***C11D 7/10*** | (2006.01) |
| ***C11D 7/20*** | (2006.01) |
| ***C11D 7/32*** | (2006.01) |

(52) U.S. Cl.

CPC .. *C11D 3/28* (2013.01); *C11D 1/66* (2013.01); *C11D 3/2093* (2013.01); *C11D 1/02* (2013.01); *C11D 3/2096* (2013.01); *C11D 1/83* (2013.01); *C11D 3/046* (2013.01); *C11D 3/1213* (2013.01); *C11D 7/10* (2013.01); *C11D 7/20* (2013.01); *C11D 7/3281* (2013.01)

USPC ..... 510/500; 510/238; 510/505; 510/508; 510/351; 510/356; 510/357

(58) Field of Classification Search

CPC ..... C11D 1/02; C11D 1/66; C11D 1/83; C11D 3/2093; C11D 3/2096; C11D 3/28; B08B 3/04

USPC ..... 510/238, 245, 303, 372, 500, 505, 508, 510/351, 356, 357; 134/25.2

See application file for complete search history.

(56) References Cited

U.S. PATENT DOCUMENTS

| | | | | |
|---|---|---|---|---|
| 3,269,904 | A | 8/1966 | Bernstein et al. | |
| 3,961,054 | A | 6/1976 | Furia et al. | |
| 4,049,665 | A | 9/1977 | Douglass | |
| 5,234,618 | A | 8/1993 | Kamegai et al. | |
| 5,336,425 | A * | 8/1994 | Aoki et al. | 510/254 |
| 5,393,447 | A * | 2/1995 | Carlson et al. | 510/257 |
| 5,739,096 | A | 4/1998 | Rees | |
| 5,929,012 | A | 7/1999 | Del Duca et al. | |
| 6,110,883 | A | 8/2000 | Petri et al. | |
| 6,297,209 | B1 * | 10/2001 | Kaaret et al. | 510/380 |
| 6,429,215 | B1 | 8/2002 | Steiner et al. | |
| 2005/0009207 | A1 | 1/2005 | Vos et al. | |
| 2008/0015135 | A1 | 1/2008 | de Buzzaccarini et al. | |
| 2008/0241276 | A1 | 10/2008 | Willey et al. | |
| 2009/0137442 | A1 | 5/2009 | Batchelor et al. | |
| 2009/0176684 | A1 | 7/2009 | Gardner et al. | |
| 2011/0257071 | A1 * | 10/2011 | Miralles | 510/477 |

FOREIGN PATENT DOCUMENTS

| | | | |
|---|---|---|---|
| DE | 3117391 | A1 | 12/1982 |
| GB | 970955 | A | 9/1964 |
| JP | 4054113 | A | 2/1992 |
| WO | WO 98/21299 | A1 | 5/1990 |
| WO | WO 01/44429 | A1 | 6/2001 |
| WO | WO 2007/146027 | A1 | 12/2007 |
| WO | WO 2011/064158 | A1 | 6/2011 |

OTHER PUBLICATIONS

Search Report, 10 Pages, (Dec. 2012).

* cited by examiner

*Primary Examiner* — Gregory R Delcotto
(74) *Attorney, Agent, or Firm* — Gregory S. Darley-Emerson; Steven W. Miller

(57) ABSTRACT

This disclosure relates to detergent compositions containing pyridinol-N-oxide compounds and being substantially free of bleach. Methods for treating a stained fabric using such detergent compositions are also disclosed.

14 Claims, No Drawings

DETERGENT COMPOSITIONS CONTAINING PYRIDINOL-N-OXIDE COMPOSITIONS

CROSS REFERENCE TO RELATED APPLICATION

This Application claims priority to U.S. Provisional Application Ser. No. 61/523,444, filed Aug. 15, 2011.

FIELD OF THE INVENTION

This disclosure relates to detergent compositions containing pyridinol-N-oxide compounds and being substantially free of bleach.

BACKGROUND OF THE INVENTION

Laundry detergent compositions that comprise chelating agents are known. For example, the chelating agent tiron, 1,2-dihydroxybenzene-3,5-disulfonic acid, is known in the art of detergent compositions as a cleaning agent. Tiron delivers hydrophilic cleaning benefits, particularly on bleachable stains, and may also drive particulate cleaning via clay peptization, suspension, and/or synergy with polymeric dispersing systems. However, tiron and other related chelants are known to bind to ions of certain transition metals, which may be present as contaminants in detergent compositions, and form colored metal/chelant complexes. For example, tiron binds to ferric iron to form a burgundy red metal/tiron complex that can be detected at metal ion concentrations of 0.1 parts per million (ppm) or even lower. Many detergent compositions contain concentrations of soluble iron, such as ferric iron, as an impurity, and the concentration of ferric iron in these detergents is enough to form sufficient metal/chelant complexes to give the detergent a reddish color. Consumers may disfavor reddish-colored detergents, as a reddish color may be associated with, for example, rust. Furthermore, such color formation may make it difficult to create a consistently-colored finished product.

Laundry detergent compositions comprising bleach and a chelating agent are also known. It is believed that the chelant may bind to metal ions present in the composition or on the target fabric, resulting in, for example, a reduced rate of peroxygen bleach decomposition. Examples of such chelants include: phosphonate chelants, such as ethydronic acid and hydroxy-ethane diphosphonic acid (HEDP); polyfunctionally-substituted aromatic chelants, such as 1,2-dihydroxy-3,5-disulfobenzene (tiron); succinate chelants, such as ethylenediamine N,N'-disuccinic acid (EDDS); amino carboxylate chelants, such as diethylene triamine pentoacetate (DTPA) and propylene diamine tetracetic acid (PDTA); polycarboxylic acids of pyridine, such as dipicolinic acid; and others, including malonic acid and hydroxy-pyridine-N-oxides, e.g., 2-hydroxy-pyridine-1-oxide.

It would be desirable to produce a detergent composition—which is substantially free of bleach—that comprises a chelating agent and provides hydrophilic cleaning benefits, particularly on bleachable stains, without undesirable color formation. It has been discovered that such a detergent composition may be produced by specifically selecting and including certain derivatives of pyridine-N-oxide as the chelating agent in the detergent composition.

SUMMARY OF THE INVENTION

In one aspect, the present disclosure provides a detergent composition comprising ferric iron and a substituted or unsubstituted 2-pyridinol-N-oxide compound, a tautomer thereof, or a salt thereof, where the detergent composition is substantially free of bleach.

In another aspect, the present disclosure provides a method of treating and/or pretreating a stained fabric by applying the detergent composition described above to the stained fabric.

In yet another aspect, the present disclosure provides a detergent composition comprising ferric iron and a compound selected from the group consisting of: 2-hydroxypyridine-1-oxide; 3-pyridinecarboxylic acid, 2-hydroxy-, 1-oxide; 6-hydroxy-3-pyridinecarboxylic acid, 1-oxide; 2-hydroxy-4-pyridinecarboxylic acid, 1-oxide; 2-pyridinecarboxylic acid, 6-hydroxy-, 1-oxide; 6-hydroxy-3-pyridinesulfonic acid, 1-oxide; a tautomer thereof; a salt thereof; and mixtures thereof; where the detergent composition is substantially free of bleach.

In still another aspect, the present disclosure provides a use of substituted or unsubstituted 2-pyridinol-N-oxide compound, a tautomer thereof, or a salt thereof to treat a hydrophilic stain on a fabric.

DETAILED DESCRIPTION OF THE INVENTION

A. Definitions

The term "fabric" encompasses articles of clothing, linen, drapery, and clothing accessories. The term also encompasses other items made in whole or in part of fabric, such as tote bags, furniture covers, tarpaulins and the like.

"Stain" or "soil" as used herein means any undesirable substance on a fabric that is the target of removal. Generally, stains are found only on a portion of the fabric and are generated by accidental contact between the soil and the fabric. The term "hydrophilic stain" as used herein means that the stain is comprised of water at the time it first came in contact with the fabric, or the stain retains a significant portion of water on the fabric. A hydrophilic stain comprises one or more of the following exemplary hydrophilic soils: beverages, many food soils, water soluble dyes, bodily fluids such as sweat, urine or blood, outdoor soils such as grass stains and mud. The term "hydrophobic stains" means the stain comprises primarily of lipophilic soils, which have high solubility in or affinity for the lipophilic fluid. Examples of lipophilic soils include but are not limited to: body soils, such as mono-, di-, and tri-glycerides, saturated and unsaturated fatty acids, non-polar hydrocarbons, waxes and wax esters, lipids, laundry materials such as nonionic surfactants, and mixtures thereof.

"Substantially free" of a particular ingredient(s), as used herein, is to be understood to mean that specifically none, or alternatively no functionally useful amount, of the specific ingredient(s) is purposefully added to the composition. It is understood to one of ordinary skill in the art that trace amounts of various ingredient(s) may be present as impurities or contaminants. Alternatively, "substantially free" can be taken to mean that the composition contains less than about 0.5%, alternatively less than about 0.1%, or alternatively less than about 0.01%, by weight of the composition of an indicated ingredient. It is understood to one of ordinary skill in the art that certain ingredients, whether purposefully added or present as impurities, may decompose over time or react with other ingredients so that the final product may contain minimal concentrations, including 0%, of such ingredients. For the avoidance of doubt, to determine whether a composition is "substantially free" of an ingredient, measurements of the ingredient's percentage by weight may be taken, for example, immediately after the composition has been manufactured, when the composition is packaged and/or shipped for sale, when the composition is obtained by a consumer, or after the composition has been stored by the consumer.

"Pretreatment" or "to pretreat," as used herein, means that the liquid composition is applied onto soiled fabric and left to act on the fabric before the fabric is washed. The composition may remain in contact with the fabric until the composition dries or for a longer period of time, or for a period of 1 minute to 24 hours, alternatively 1 minute to 1 hour, alternatively 5 minutes to 30 minutes. Optionally, when the fabric is soiled with encrusted stains/soils that would otherwise be difficult to remove, the compositions according to the present invention may be rubbed and/or brushed more or less intensively, for example, by means of a sponge or a brush or simply by rubbing two pieces of fabric each against the other.

"Treatment" or "to "treat," as used herein, means that the liquid composition, in neat form or diluted in a liquor, e.g., a wash liquor, is applied onto or contacted with soiled fabric.

"Cleaning agent," as used herein, is to be understood as a substance or compound that directly delivers cleaning benefits, such as removal of laundry soils. "Directly," as used herein, is to be understood that the cleaning agent itself acts to, for example, remove laundry soils, as opposed to potentiating the cleaning benefits of another substance.

"Washing," as used herein, is to be understood as to rinse a fabric with water or to wash the fabric with a detergent composition, e.g., a conventional detergent composition comprising at least one surfactant, by means of a washing machine or by hand.

It is to be understood that within the scope of this invention numerous potential and actual resonance structures and tautomers exist. Thus, for example, pyridine-N-oxide can be represented as resonance forms (I), (II), and (III) pictured below. And, for example, the tautomeric form of 2-pyridinol-N-oxide (IV) is 1-Hydroxy-2(1H)-pyridinone, as shown in structure (V) below. In the art, resonance structures are frequently represented by one single structure, such as (III), pictured below. It is to be understood that when this disclosure refers to a particular structure, all of the reasonable resonance structures and tautomers are included.

(I)

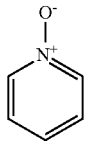

(II)

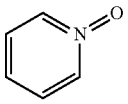

(III)

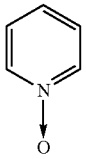

-continued (IV)

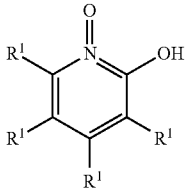

(V)

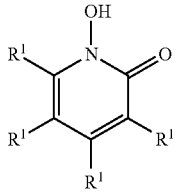

B. Detergent Composition

The present disclosure is directed to a detergent composition—which is substantially free of bleach—that comprises a chelating agent and provides hydrophilic cleaning benefits, particularly on bleachable stains. More specifically, the present disclosure is directed to a detergent composition, which is substantially free of bleach, comprising a substituted or unsubstituted 2-pyridinol-N-oxide compound, a tautomer thereof, or a salt thereof, as a chelating agent, where the detergent composition provides hydrophilic cleaning benefits, particularly on bleachable stains, without forming an undesirably colored chelant/metal complex in the presence of certain transition metals, e.g., ferric iron, that are commonly present as impurities in the detergent composition.

Ferric Iron

The detergent compositions of the present disclosure may comprise ferric iron, also known as iron(III) or $Fe^{3+}$. The ferric iron may be bonded with ionic bonds to other ions, coordinated with a ligand to form a ligand:iron coordination complex, or freely dissociated in solution.

Ferric iron, which is soluble, can be found in many commercially available detergents. For example, the iron levels of a collection of "off-the-shelf" samples of heavy duty liquid (HDL) detergents have been measured. Commercially available HDL detergents showed an average total iron concentration of 0.6-0.7±0.2 parts per million (ppm). These iron levels are sufficient to promote formation of a colored metal:chelant complex upon the addition of certain chelants, e.g., tiron, to the HDL detergent. The formation of such colored complexes may result in the detergent composition developing an undesirable color. This resulting color may prevent the current dye systems utilized in these detergents from attaining a consumer-preferred product color.

In certain aspects of the present invention, the iron may be provided intentionally or unintentionally, as an impurity or contaminant, in the composition. For example, iron may be present as a contaminant from the synthesis or transport of surfactant, chelants, citric acid, or sodium hydroxide in the detergent formulation.

In certain aspects, the detergent composition comprises ferric iron at a concentration of at least about 5 parts per million (ppm), or alternatively at least about 1 ppm, or alternatively at least about 0.6 ppm, or alternatively at least about 0.4 ppm, or alternatively at least about 0.2 ppm, or alternatively at least about 0.1 ppm. In other aspects, the mole ratio of substituted or unsubstituted 2-pyridinol-N-oxide compound, a tautomer thereof, or a salt thereof to ferric iron in the detergent composition is greater than about 3:1, or greater than about 10:1, or greater than about 20:1.

2-pyridinol-N-oxide

The detergent composition according to the present invention may comprise a substituted or unsubstituted 2-pyridinol-N-oxide compound or a salt thereof, as a chelating agent. Included within the scope of this invention are tautomers of this compound, e.g., 1-Hydroxy-2(1H)-pyridinone, as chelating agents. The substituted or unsubstituted 2-pyridinol-N-oxide compound and its corresponding tautomeric form, 1-Hydroxy-2(1H)-pyridinone, are shown below:

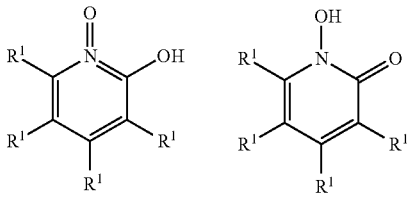

where each $R^1$ group is independently selected from the group consisting of H, Cl, Br, I, F, NO, $NO_2$, and $(CH_2)_nG$, where each G is independently selected from the group consisting of $(O)_mSO_3M$, $(O)_mCO_2M$, $(O)_mC(O)(R^2)$, $(O)_mC(O)N(R^2)_2$, $(O)_mCN$, $(O)_m(R^2)$, and $N(R^2)_2$, where each m is 0 or 1, each n is an integer from 0 to 4, each $R^2$ is independently selected from the group consisting of H and a substituted or unsubstituted $C_1$-$C_{12}$ organic group, and each M is independently selected from the group consisting of $R^2$ where $R^2$ is defined as above, $N^+(R^2)_4$, and $1/q\ M'^{q+}$ where M' is selected from the group consisting of an alkali metal of charge q and an alkaline earth metal of charge q, and where any two vicinal $R^1$ groups may be taken together to form another five- or six-membered aromatic or aliphatic ring optionally substituted with one or more groups selected from the group consisting of Cl, Br, I, F, NO, $NO_2$, CN, $(CH_2)_nG$, and mixtures thereof. Suitable organic groups include $(C_1$-$C_{12})$alkyl, $(C_2$-$C_{12})$alkenyl, and $(C_2$-$C_{12})$alkynyl. The organic group may optionally be substituted and suitable substituent groups include a hydroxyl group, a carboxyl group, and an amino group. 2-pyridinol-N-oxide is also known, for example, as 2-hydroxypyridine-N-oxide, 2-pyridinol-1-oxide, or 2-hydroxypyridine-1-oxide.

In certain aspects, the detergent composition comprises a 2-pyridinol-N-oxide compound or tautomer thereof according to the formula(s) above, where each $R^1$ is independently selected from the group consisting of H, Cl, and $(CH_2)_nG$, where G is independently selected from the group consisting of $(O)_mSO_3M$, $(O)_mCO_2M$, $(O)_mC(O)(R^2)$, $(O)_mCN$, and $(O)_m(R^2)$, where each m is 0 or 1. In other aspects, the detergent composition comprises a 2-pyridinol-N-oxide compound according to the formula above, where each $R^1$ is independently selected from the group consisting of H, $SO_3M$, and $CO_2M$. In still other aspects, each $R^1$ is independently selected from the group consisting of H, $SO_3M$, and $CO_2M$, where no more than one $R^1$ is $SO_3M$ or $CO_2M$.

In certain aspects, the detergent composition comprises the salt of a substituted or unsubstituted 2-pyridinol-N-oxide compound. In these aspects, the hydrogen of the hydroxyl group of the 2-pyridinol-N-oxide compound may be substituted with a suitable charge-balancing cation. In these aspects, non-limiting examples of the hydrogen-substituting cation include $Na^+$, $Li^+$, $K^+$, ½ $Mg^{2+}$, or ½ $Ca^{2+}$, substituted ammonium, such as $C_1$-$C_6$ alkanolammnonium, mono-ethanolamine (MEA), tri-ethanolamine (TEA), di-ethanolamine (DEA), or any mixture thereof. In some aspects, in solution, the cation may be dissociated from the 2-pyridinol-N-oxide or the 1-Hydroxy-2(1H)-pyridinone anion.

In some aspects, the 2-pyridinol-N-oxide compound is selected from the group consisting of: 6-hydroxy-3-pyridinesulfonic acid, 1-oxide (CAS 191672-18-1); 2-hydroxypyridine-1-oxide (CAS 13161-30-3); 2-hydroxy-4-pyridinecarboxylic acid, 1-oxide (CAS 13602-64-7); 5-ethoxy-2-pyridinol, 2-acetate, 1-oxide (CAS 51984-49-7); 1-(3-hydroxy-2-oxido-4-isoquinolinyl)-ethanone (CAS 65417-65-4); 6-hydroxy-3-pyridinecarboxylic acid, 1-oxide (CAS 90037-89-1); 2-methoxy-4-quinolinecarbonitrile, 1-oxide (CAS 379722-76-6); 2-pyridinecarboxylic acid, 6-hydroxy-, 1-oxide (CAS 1094194-45-2); 3-pyridinecarboxylic acid, 2-hydroxy-, 1-oxide (CAS 408538-43-2); 2-pyridinol, 3-nitro-, 1-oxide (CAS 282102-08-3); 3-pyridinepropanenitrile, 2-hydroxy-, 1-oxide (193605-60-6); 3-pyridineethanol, 2-hydroxy-, 3-acetate, 1-oxide (CAS 193605-56-0); 2-pyridinol, 4-bromo-, 1-oxide (CAS 170875-41-9); 2-pyridinol, 4,6-dibromo-, 2-acetate, 1-oxide (CAS 170875-40-8); 2-pyridinol, 4,6-dibromo, 1-oxide (CAS 170875-38-4); 2-pyridinol, 4-(2-aminoethyl)-, 1-oxide (CAS 154403-93-7); 2-pyridinol, 5-(2-aminoethyl)-, 1-oxide (CAS 154403-92-6); 3-pyridinepropanoic acid, α-amino-6-hydroxy-, 1-oxide (CAS 134419-61-7); 2-pyridinol, 3,5-dimethyl, 1-oxide (CAS 102074-62-4); 2-pyridinol, 3-methyl-, 1-oxide (CAS 99969-07-0); 2-pyridinol, 3,5-dinitro, 1-oxide (CAS 98136-47-1); 2-pyridinol, 3,5-dibromo-, 1-oxide (CAS 98136-29-9); 2-pyridinol, 4-methyl-6-(2-methylpropyl)-, 1-oxide (CAS 91408-77-4); 2-pyridinol, 3-bromo-4,6-dimethyl-, 1-oxide (CAS 91408-76-3); 2-pyridinol, 4,5,6-trimethyl-, 1-oxide (CAS 91408-75-2); 2-pyridinol, 6-heptyl-4-methyl-, 1-oxide (CAS 91408-73-0); 2-pyridinol, 6-(cyclohexylmethyl)-4-methyl-, 1-oxide (CAS 91408-72-9); 2-pyridinol, 6-bromo-, 1-oxide (CAS 89284-00-4); 2-pyridinol, 5-bromo-, 1-oxide (CAS 89283-99-8); 2-pyridinol, 3,5-dichloro-4,6-difluoro-, 1-oxide (CAS 33693-37-7); 2-pyridinol, 3,4,5,6-tetrachloro-, 1-oxide (CAS 32835-63-5); 2-pyridinol, 6-methyl-, 1-oxide (CAS 14420-62-3); 2-pyridinol, 5-nitro-, 1-oxide (CAS 14396-03-3); 2-pyridinol, 4-methyl-5-nitro-, 1-oxide (CAS 13602-77-2); 2-pyridinol, 4-chloro-5-nitro-, 1-oxide (CAS 13602-73-8); 2-pyridinol, 4-chloro-, 1-oxide (CAS 13602-65-8); 2-pyridinol, 4-nitro-, 1-oxide (CAS 13602-63-6); and 2-pyridinol, 4-methyl-, 1-oxide (CAS 1952-64-3), and mixtures thereof. These compounds are commercially available from, for example, Sigma-Aldrich (St. Louis, Mo.) and/or Aces Pharma (Branford, Conn.).

In certain aspects, the detergent composition comprises a 2-pyridinol-N-oxide compound selected from the group consisting of: 2-hydroxypyridine-1-oxide; 3-pyridinecarboxylic acid, 2-hydroxy-, 1-oxide; 6-hydroxy-3-pyridinecarboxylic acid, 1-oxide; 2-hydroxy-4-pyridinecarboxylic acid, 1-oxide; 2-pyridinecarboxylic acid, 6-hydroxy-, 1-oxide; 6-hydroxy-3-pyridinesulfonic acid, 1-oxide; and mixtures thereof.

In certain aspects, the detergent composition comprises a 1-Hydroxy-2(1H)-pyridinone compound selected from the group consisting of: 1-Hydroxy-2(1H)-pyridinone (CAS 822-89-9); 1,6-dihydro-1-hydroxy-6-oxo-3-Pyridinecarboxylic acid (CAS 677763-18-7); 1,2-dihydro-1-hydroxy-2-oxo-4-Pyridinecarboxylic acid (CAS 119736-22-0); 1,6-dihydro-1-hydroxy-6-oxo-2-Pyridinecarboxylic acid (CAS 94781-89-2); 1-hydroxy-4-methyl-6-(2,4,4-trimethylpentyl)-2(1H)-Pyridinone (CAS 50650-76-5); 6-(cyclohexylmethyl)-1-hydroxy-4-methyl-2(1H)-Pyridinone (CAS 29342-10-7); 1-hydroxy-4,6-dimethyl-2(1H)-Pyridinone (CAS 29342-02-7); 1-Hydroxy-4-methyl-6-(2,4,4-trimethylpentyl)-2-pyridone monoethanolamine (CAS 68890-66-4); 1-hydroxy-6-(octyloxy)-2(1H)-Pyridinone (CAS 162912-64-3); 1-Hydroxy-4-methyl-6-cyclohexyl-2-pyridinone ethanolamine salt (CAS 41621-49-2); 1-Hydroxy-4-methyl-6-cyclohexyl-2-pyridinone (CAS 29342-05-0); 6-ethoxy-1,2-dihydro-1-hydroxy-2-oxo-4-Pyridinecarboxylic acid,methyl ester (CAS 36979-78-9); 1-hydroxy-5-nitro-2(1H)-Pyridinone (CAS 45939-70-6); and mixtures thereof. These compounds are commercially available from, for example, Sigma-Aldrich (St. Louis, Mo.), Princeton Building Blocks (Monmouth Junction, N.J.), 3B Scientific Corporation (Libertyville, Ill.), SynFine Research (Richmond Hill, ON), Ryan Scientific, Inc. (Mt. Pleasant, S.C.), and/or Aces Pharma (Branford, Conn.).

In certain aspects, the detergent composition comprises a substituted or unsubstituted 2-pyridinol-N-oxide compound, a tautomer thereof, or a salt thereof that has a molecular weight of between about 111 and about 1000 daltons, or, alternatively, a molecular weight of between about 111 and about 600 daltons. In certain aspects, the pyridinol-N-oxide compound, a tautomer thereof, or a salt thereof has a molecular weight of less than about 400 daltons.

In certain aspects, a substituted or unsubstituted 2-pyridinol-N-oxide compound, a tautomer thereof, or a salt thereof can be used to treat a hydrophilic stain on a fabric. In other aspects, the substituted or unsubstituted 2-pyridinol-N-oxide compound, a tautomer thereof, or a salt thereof can be used to treat a bleachable stain on a fabric.

Included within the scope of this invention are tautomers of the above compounds or salts of said tautomers.

In certain aspects, the detergent composition comprises from about 0.01% by weight to about 5% by weight of the substituted or unsubstituted 2-pyridinol-N-oxide compound, a tautomer thereof, or a salt thereof, or from about 0.05% by weight to about 2% by weight of the substituted or unsubstituted 2-pyridinol-N-oxide compound, a tautomer thereof, or a salt thereof, or about 0.10% by weight to about 1% by weight of the substituted or unsubstituted 2-pyridinol-N-oxide compound, a tautomer thereof, or a salt thereof. In some aspects, the composition comprises from about 0.15% by weight to about 0.5% by weight of the substituted or unsubstituted 2-pyridinol-N-oxide compound, a tautomer thereof, or a salt thereof.

Bleach

The detergent compositions disclosed herein may further be substantially free of bleach. In certain aspects, the detergent composition may have no bleach purposefully added. In other aspects, the detergent composition will have no functional amount of bleach purposefully added. In still other aspects, the detergent composition may contain from about 0%, including 0%, to about 0.01% by weight bleach.

In certain aspects, the term "bleach" may include peroxygen bleaches. Peroxygen bleaches may include hydrogen peroxide, sources of peroxide, or a mixture thereof. As used herein, a source of peroxide refers to a compound or system that produces and/or generates peroxide ions in solution. Sources of peroxide include percarbonates, persilicate, persulphate such as monopersulfate, perborates (including any hydrate thereof, including the mono- or tetra-hydrate), peroxyacids such as diperoxydodecanedioic acid (DPDA), magnesium perphthalic acid, dialkylperoxides, diacylperoxides, preformed percarboxylic acids, organic and inorganic peroxides and/or hydroperoxides or mixtures thereof. Additionally, hydrogen peroxide sources are described in detail in the herein incorporated Kirk Othmer's Encyclopedia of Chemical Technology, 4th Ed (1992, John Wiley & Sons), Vol. 4, pp. 271-300 "Bleaching Agents (Survey)", and include the various forms of sodium perborate and sodium percarbonate, including various coated and modified forms.

In other aspects, "bleach" may also include hypohalite bleaches and sources thereof. Non-limiting examples of hypohalite bleaches or sources thereof include a simple hypochlorite salt, such as those of the alkali or alkaline earth metals, or a compound which produces hypochlorite on hydrolysis, such as organic N-chloro compounds. Other hypohalites may include hypobromite, which is conveniently provided in situ from a bromide salt and a suitable strong oxidant such as hypochlorite.

Surfactant

According to certain aspects disclosed herein, the detergent compositions of the present disclosure may further comprise a surfactant selected from the group consisting of an anionic surfactant, a nonionic surfactant, a cationic surfactant, a zwitterionic surfactant, an amphoteric surfactant, and mixtures thereof. Such compositions may comprise a sufficient amount of a surfactant to provide the desired level of one or more cleaning properties, typically from about 5% to about 90% by weight of the total composition, from about 5% to about 70% by weight of the total composition, or from about 5% to about 40% by weight of the total composition. Typically, the detergent is used in the wash solution at a level of from about 0.0001% to about 0.05%, or even from about 0.001% to about 0.01% by weight of the wash solution.

The liquid detergent compositions may comprise an aqueous, non-surface active liquid carrier. Generally, the amount of the aqueous, non-surface active liquid carrier employed in the compositions herein will be effective to solubilize, suspend, or disperse the composition components. For example, the compositions may comprise, by weight, from about 5% to about 90%, from about 10% to about 70%, or from about 20% to about 70% of an aqueous, non-surface active liquid carrier.

The most cost effective type of aqueous, non-surface active liquid carrier may be water. Accordingly, the aqueous, non-surface active liquid carrier component may be mostly, if not completely, water. While other types of water-miscible liquids, such alkanols, diols, other polyols, ethers, amines, and the like, have been conventionally added to liquid detergent compositions as co-solvents or stabilizers, the utilization of such water-miscible liquids may be minimized to hold down composition cost. Accordingly, the aqueous liquid carrier component of the liquid detergent products herein will generally comprise water present in concentrations ranging from about 5% to about 90%, or from about 20% to about 70%, by weight of the composition.

The liquid detergent compositions herein may take the form of an aqueous solution or uniform dispersion or suspension of surfactant, dual character polymer, and certain optional adjunct ingredients, some of which may normally be in solid form, that have been combined with the normally liquid components of the composition, such as the liquid alcohol ethoxylate nonionic, the aqueous liquid carrier, and any other normally liquid optional ingredients. Such a solution, dispersion or suspension will be acceptably phase stable and will typically have a viscosity which ranges from about 100 to 600 cps, or from about 150 to 400 cps. For purposes of this disclosure, viscosity is measured with a Brookfield LVDV-II+ viscometer apparatus using a #21 spindle.

Suitable surfactants may be anionic, nonionic, cationic, zwitterionic and/or amphoteric surfactants. Specific, non-limiting examples of suitable anionic surfactants include any conventional anionic surfactant typically used in detergent products. These include the alkyl benzene sulfonic acids and their salts as well as alkoxylated or non-alkoxylated alkyl sulfate materials.

Exemplary anionic surfactants are the alkali metal salts of $C_{10}$-$C_{16}$ alkyl benzene sulfonic acids, or $C_{11}$-$C_{14}$ alkyl benzene sulfonic acids. In one aspect, the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Especially useful are the sodium and potassium linear straight chain alkylbenzene sulfonates in which the average number of carbon atoms in the alkyl group is from about 11 to 14. Sodium $C_{11}$-$C_{14}$, e.g., $C_{12}$, LAS is a specific example of such surfactants.

Another exemplary type of anionic surfactant comprises ethoxylated alkyl sulfate surfactants. Such materials, also known as alkyl etromher sulfates or alkyl polyethoxylate sulfates, are those which correspond to the formula: R'—O—$(C_2H_4O)_n$—$SO_3M$ wherein R' is a $C_8$-$C_{20}$ alkyl group, n is from about from 0.5 to 20, or from 1 to 20, and M is a salt-forming cation. In one aspect, R' is $C_{10}$-$C_{18}$ alkyl, n is from about 1 to 15, and M is sodium, potassium, ammonium, alkylammonium, or alkanolammonium. In one aspect, R' is a $C_{12}$-$C_{16}$, n is from about 0.5 to 6, or from 1 to 6 and M is sodium.

The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions of this invention and used as or in any anionic surfactant component which may be present. Specific examples of non-alkoxylated, e.g., non-ethoxylated, alkyl ether sulfate surfactants are those produced by the sulfation of higher $C_8$-$C_{20}$ fatty alcohols. Conventional primary alkyl sulfate surfactants have the general formula: $ROSO_3$-$M^+$ wherein R is typically a linear $C_8$-$C_{20}$ hydrocarbyl group, which may be straight chain or branched chain, and M is a water-solubilizing cation. In one aspect, R is a $C_{10}$-$C_{15}$ alkyl, and M is alkali metal, more specifically R is $C_{12}$-$C_{14}$ and M is sodium.

Specific, non-limiting examples of anionic surfactants useful herein include: a) $C_{10}$-$C_{18}$ alkyl benzene sulfonates (LAS) including those in which the alkyl groups have a bio-based content of at least 5% (Bio-LAS and/or Bio-MLAS) b) $C_{10}$-$C_{20}$ primary, branched-chain and random alkyl sulfates (AS), including predominantly $C_{12}$ alkyl sulfates; c) $C_{10}$-$C_{18}$ secondary (2,3) alkyl sulfates having formulae (I) and (II): wherein M in formulae (I) and (II) is hydrogen or a cation which provides charge neutrality, and all M units, whether associated with a surfactant or adjunct ingredient, can either be a hydrogen atom or a cation depending upon the form isolated by the artisan or the relative pH of the system wherein the compound is used, with non-limiting examples of suitable cations including sodium, potassium, ammonium, and mixtures thereof, and x is an integer of at least about 7, or at least about 9, and y is an integer of at least 8, or at least about 9; d) $C_{10}$-$C_{18}$ alkyl alkoxy sulfates ($AE_xS$) wherein x is from 1-30; e) $C_{10}$-$C_{18}$ alkyl alkoxy carboxylates in one aspect, comprising 1-5 ethoxy units; f) mid-chain branched alkyl sulfates as discussed in U.S. Pat. No. 6,020,303 and U.S. Pat. No. 6,060,443; g) mid-chain branched alkyl alkoxy sulfates as discussed in U.S. Pat. No. 6,008,181 and U.S. Pat. No. 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

Another suitable class of anionic surfactants comprises surfactant derivatives of isoprenoid-based polybranched detergent alcohols as described in US 2010/0137649. A suitable feedstock for these includes beta-farnesene, such as BioFene™ supplied by Amyris, Emeryville, Calif.

Another suitable anionic surfactant is a branched surfactant from isoprenoid-derived alcohols, anteiso and iso-alcohols. This includes mixtures of at least two compounds of Formula I:

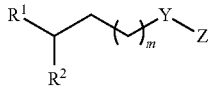

I

In this mixture, $R^1$ is hydrogen, methyl, or ethyl;

$R^2$ is $(C_1$-$C_n)$alkyl or $(C_1$-$C_n)$alkenyl having 0, 1, 2, or 3 $(C_1$-$C_3)$alkyl branches;

m is 5-37 and n is 1-33, wherein m+n is 6-38; preferably m is 7-27 and n is 1-23, wherein m+n is 8-28;

Y is null or $W_p$;

W is selected from the group consisting of ethylenoxy, propylenoxy, butylenoxy, and mixtures thereof;

p is 1 to 30; and

Z is a hydrophilic moiety such as, for example, hydroxy, carboxylate, sulfate, disulfate, sulfonate, disulfonate, glycerol ester sulfonate, amine, monoalkylamine, dialkylamine, amine oxide, a polyhydroxy moiety, a phosphate ester, glycerol sulfonate, polygluconate, a polyphosphate ester, phosphonate, sulfosuccinate, sulfosuccaminate, glucamide, taurinate, sarcosinate, glycinate, isethionate, dialkanolamide, monoalkanolamide, monoalkanolamide sulfate, diglycolamide, diglycolamide sulfate, a glycerol ester, a glycerol ester sulfate, a glycerol ether, a glycerol ether sulfate, a polyglycerol ether, a polyglycerol ether sulfate, sorbitan ester, an alkylpolyglycoside (APG), alkylpolyxyloside, urea, ammonioalkanesulfonate, amidopropyl betaine, an allylated quat, an alkyated/polyhydroxyalkylated quat, an alkylated quat, an alkylated/polyhydroxylated oxypropyl quat, a glycerol ester quat, a glycol amine quat, imidazoline, alken-2-yl-succinate, a sulfonated alkyl ester, and a sulfonated fatty acid. Preferably, Z is selected from the group consisting of hydroxy, glycerol ether, polyglycerol ether, polyglycoside, polyxyloside, carboxylate, sulfate, sulfonate, glycerol ether sulfonate, amine, monoalkylamine, dialkylamine, amine oxide, monoalkanolamide, amidopropyl betaine, and an alkylated quat. In one aspect herein, the foregoing selections for Z do not include carboxylate.

In one aspect, with respect to at least one of the compounds, when $R^1$ is H, $R^2$ has 1, 2, or 3 $(C_1$-$C_3)$ alkyl branches, and when $R^1$ is methyl or ethyl, $R^2$ has 0, 1, or 2 $(C_1$-$C_3)$alkyl branches. In another aspect, with respect to the at least two compounds in the mixture, when $R^1$ is H, $R^2$ has 1, 2, or 3 $(C_1$-$C_3)$ alkyl branches, and when $R^1$ is methyl or ethyl, $R^2$ has 0, 1, or 2 $(C_1$-$C_3)$alkyl branches. Alternatively or additionally, in yet another aspect, the branching occurs on carbon atoms that are within 40% of the nonfunctionalized terminus of the longest carbon chain. Alternatively or additionally, in yet another aspect, the composition is substantially free of secondary hydroxy compounds.

Another suitable anionic surfactant comprises a mixture of at least two compounds selected from the group consisting of:

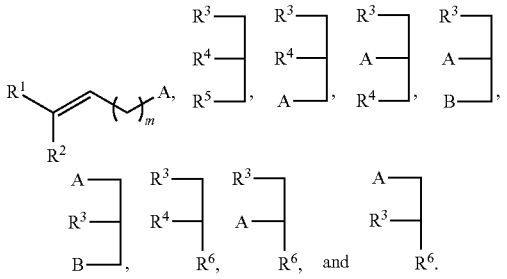

In this mixture, A and B are each independently OH or $O(C{=}O)R^7$;

$R^1$ is hydrogen, methyl, or ethyl;

$R^2$ is $(C_1\text{-}C_n)$ alkyl or $(C_1\text{-}C_n)$alkenyl having 0, 1, 2, or 3 $(C_1\text{-}C_3)$alkyl branches;

$R^3$, $R^4$, and $R^5$ are each independently

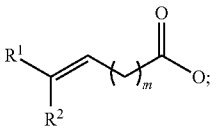

$R^6$ is hydrogen, methyl, or ethyl;

$R^7$ is $(C_1\text{-}C_{26})$ alkyl; and, m is 5-37 and n is 1-33, wherein m+n is 6-38; preferably m is 7-27 and n is 1-23, wherein m+n is 8-28.

In one aspect, when $R^1$ is H, $R^2$ has 1, 2, or 3 $(C_1\text{-}C_3)$ alkyl branches, and when $R^1$ is methyl or ethyl, $R^2$ has 0, 1, or 2 $(C_1\text{-}C_3)$alkyl branches. Alternatively or additionally, in yet another aspect, the branching occurs on carbon atoms that are within 40% of the nonfunctionalized terminus of the longest carbon chain. Alternatively or additionally, in yet another aspect, the composition is substantially free of secondary hydroxy compounds.

In another aspect, a suitable anionic surfactant comprises the partially saturated versions of the above compounds or fully saturated versions of the above compounds, wherein an above compound is hydrogenated to provide the partially saturated or fully saturated version thereof.

A suitable anionic surfactant may also comprise a mixture of at least two compounds of Formula IV:

IV

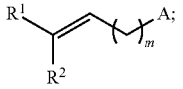

In this mixture, A in each of the at least two compounds is independently COOH, $COO^-M$, $O(C{=}O)R^7$ or $(C{=}O)OR^7$;

$R^1$ is hydrogen, methyl, or ethyl;

$R^2$ is $(C_1\text{-}C_n)$alkyl or $(C_1\text{-}C_n)$alkenyl having 0, 1, 2, or 3 $(C_1\text{-}C_3)$alkyl branches, wherein when $R^1$ is H, $R^2$ has 1, 2, or 3 $(C_1\text{-}C_3)$alkyl branches, and when $R^1$ is methyl or ethyl, $R^2$ has 0, 1, or 2 $(C_1\text{-}C_3)$alkyl branches, and wherein branching occurs on carbon atoms that are within 40% of the nonfunctionalized terminus of the longest carbon chain;

$R^7$ is $(C_1\text{-}C_{26})$alkyl;

M is $Li^+$, $Na^+$, $K^+$, $Ca^{2+}$, $Mg^{2+}$, and

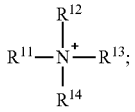

$R^{11}$, $R^{12}$, $R^{13}$, and $R^{14}$ are each independently hydrogen, $(C_1\text{-}C_{22})$alkyl, $(C_1\text{-}C_6)$alkanol, and $(C_1\text{-}C_{22})$alkenyl;

m is 5-37 and n is 1-33, wherein m+n is 6-38; preferably m is 7-27 and n is 1-23, wherein m+n is 8-28.

In one aspect, when $R^1$ is H, $R^2$ has 1, 2, or 3 $(C_1\text{-}C_3)$alkyl branches, and when $R^1$ is methyl or ethyl, $R^2$ has 0, 1, or 2 $(C_1\text{-}C_3)$alkyl branches. Alternatively or additionally, in one aspect, the branching occurs on carbon atoms that are within 40% of the nonfunctionalized terminus of the longest carbon chain. Alternatively or additionally, in yet another aspect, the composition is substantially free of secondary hydroxy compounds.

In another aspect, a suitable anionic surfactant comprises the partially saturated version of the above compounds, wherein an above compound is hydrogenated to provide the partially saturated version thereof.

Suitable anionic surfactants may also include mixtures of at least two compounds of Formula I:

(I)

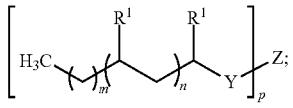

wherein each $R^1$ independently is H or $CH_3$, with the proviso that 1, 2, or 3 $R^1$ is $CH_3$;

m is 1 or 2;

n is 3, 4, 5, 6, 7, 8, or 9;

p is 1, 2, 3, 4, 5, 6, 7, or 8; and,

Y is $CH_2$ or absent, with the proviso that when:

(a) Y is $CH_2$, Z is selected from the group consisting of hydroxyl, an alkoxyl, a sulfate, a disulfate, a sulfonate, a disulfonate, a sulfosuccinate, an amine, a monoalkylamine, a dialkylamine, an amine oxide, a polyhydroxy moiety, a phosphate ester, a polyphosphate ester, a phosphonate, a glycerol ether, a glycerol ether sulfonate, a polygluconate, a monoglycerol ether, a diglyerol ether, a glycerol ether sulfate, a polyglycerol ether, a polyglycerol ether sulfate, a polyglucoside, an ammonioalkanesulfonate, an alkylated quat, an alkyated/hydroxyalkylated quat, an alkylated/polyhydroxyakylated quat, an alkylated/polyhydroxylated oxypropyl quat, a glycol amine quat, a polyoxyalkylene, an alkoxylated sulfate, a pyridinium moiety, a betaine, a sulfobetaine, an aminocarboxylate, an iminodicarboxylate, a phenol ethoxylate, an imidazoline, an O-alkyl ester (i.e., $O(C{=}O)R$, wherein R is an alkyl group), and an alkoxylated carboxylate; and, (b) Y is absent, Z is selected from the group consisting of a carboxylic acid, a carboxylate, a glycerol ester sulfonate, a sulfosuccinamate, a glucamide, a taurinate, a sarcosinate, a glycinate, a dialkanolamide, a monoalkanolamide, a monoalkanolamide sulfate, a diglycolamide, a diglycolamide sulfate, a glycerol ester, a glycerol ester sulfate, an amidopropyl betaine, a sugar ester (e.g., a sorbitan ester), a glycerol ester quat, an isethionate, a sulfonated fatty acid, a sulfonated alkyl ester, a C-alkyl ester (i.e., (C═O)OR, wherein R is an alkyl group), an amide, and a polyalkoxylated amidopropyl betaine.

The mixture comprises no more than about 5 wt. %, preferably no more than about 3 wt. %, more preferably no more than about 1 wt. % of compounds that have a longest linear carbon chain of 9 carbon atoms or fewer. Further still, the mixture comprises less than about 50 wt. % of compounds of Formula I that have branching on a carbon atom that is within 40% of the nonfunctionalized terminus of the longest carbon chain, based on the total weight of the mixture.

In some aspects, the mixture of the at least two compounds of Formula I further comprises at least one compound of Formula III:

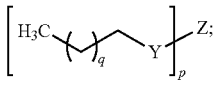

(III)

wherein q is 7, 8, 9, 10, 11, 12, 13, 14, 15, 19, 17, 18, 19, or 20; p is 1, 2, 3, 4, 5, 6, 7, or 8; and, Y is $CH_2$ or absent, with the proviso that when:

(a) Y is $CH_2$, Z is selected from the group consisting of hydroxyl, an alkoxyl, a sulfate, a disulfate, a sulfonate, a disulfonate, a sulfosuccinate, an amine, a monoalkylamine, a dialkylamine, an amine oxide, a polyhydroxy moiety, a phosphate ester, a polyphosphate ester, a phosphonate, a glycerol ether, a glycerol ether sulfonate, a polygluconate, a monoglycerol ether, a diglyerol ether, a glycerol ether sulfate, a polyglycerol ether, a polyglycerol ether sulfate, a polyglucoside, an ammonioalkanesulfonate, an alkylated quat, an alkyated/hydroxyalkylated quat, an alkylated/polyhydroxyakylated quat, an alkylated/polyhydroxylated oxypropyl quat, a glycol amine quat, a polyoxyalkylene, an alkoxylated sulfate, a pyridinium moiety, a betaine, a sulfobetaine, an aminocarboxylate, an iminodicarboxylate, a phenol ethoxylate, an imidazoline, an O-alkyl ester, and an alkoxylated carboxylate; and, (b) Y is absent, Z is selected from the group consisting of a carboxylic acid, a carboxylate, a glycerol ester sulfonate, a sulfosuccinamate, a glucamide, a taurinate, a sarcosinate, a glycinate, a dialkanolamide, a monoalkanolamide, a monoalkanolamide sulfate, a diglycolamide, a diglycolamide sulfate, a glycerol ester, a glycerol ester sulfate, an amidopropyl betaine, a sugar ester, a glycerol ester quat, an isethionate, a sulfonated fatty acid, a sulfonated alkyl ester, a C-alkyl ester, an amide, and a polyalkoxylated amidopropyl betaine.

The at least one compound of Formula III is present in the mixture in an amount of at least about 1 wt. %, at least about 10 wt. %, at least about 30 wt. %, at least about 50 wt. %, at least about 70 wt. %, at least about 80 wt. %, at least about 90 wt. %, or at least about 95 wt. %, based on the total weight of the mixture. For example, the at least one compound of Formula III can be present in the mixture in an amount of about 1 wt. % to about 95 wt. %, based on the total weight of the mixture.

In some aspects, the

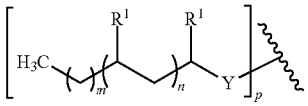

component of the at least two compounds of Formula I has a biobased content of at least about 50%, at least about 60%, at least about 70%, at least about 80%, at least about 90%, at least about 95%, at least about 97%, or about 100%.

In some aspects, the at least one compound of Formula I contains a methyl branch at a position selected from the group consisting of the 2-, 4-, 6-, 8-, 10-, 12-, or 14-position. In some aspects, a compound of Formula I contains one methyl branch. In these aspects, the one methyl branch is at a position selected from the group consisting of the 2-, 4-, 6-, 8-, 10-, 12-, or 14-position.

In another aspect, a suitable anionic surfactant comprises a mixture of at least two compounds of Formula I, as previously described, wherein the mixture is produced by (a) culturing a cell comprising:

(i) an exogenous or overexpressed polynucleotide comprising a nucleic acid sequence encoding a polypeptide that catalyzes the conversion of propionyl-CoA to methylmalonyl-CoA; and/or, (ii) an exogenous or overexpressed polynucleotide comprising a nucleic acid sequence encoding a polypeptide that catalyzes the conversion of succinyl-CoA to methylmalonyl-CoA, under conditions allowing expression of the polynucleotide(s) and production a mixture of at least two compounds of Formula II:

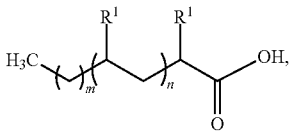

(II)

wherein the cell produces more compounds of Formula II than an otherwise similar cell that does not comprise the polynucleotide(s);

(b) extracting from culture the mixture of at least two compounds of Formula II; and, (c) derivatizing the compounds of Formula (II) to form the mixture of at least two compounds of Formula I.

Additional suitable anionic surfactants include branched fatty alcohols with C6- to C15-residues such as those sold under the trade names Safol 23, Marlipal 013, Isalchem 123, Isalchem 125 and Marlipal 031.

Suitable nonionic surfactants useful herein may comprise any of the conventional nonionic surfactant types typically used in liquid detergent products. These include, for example, alkoxylated fatty alcohols and amine oxide surfactants. Preferred for use in the liquid detergent products herein are those nonionic surfactants which are normally liquid. Suitable nonionic surfactants for use herein include the alcohol alkoxylate nonionic surfactants. Alcohol alkoxylates are materials which correspond to the general formula: $R^1(C_mH_{2m}O)_pOH$ where $R^1$ is a $C_8$-$C_{16}$ alkyl group, m is from 2 to 4, and p ranges from about 2 to 12. Preferably $R^1$ is an alkyl group which may be primary or secondary and that contains from about 9 to about 15 carbon atoms, more preferably from about 10 to about 14 carbon atoms. In one aspect, the alkoxylated fatty alcohols may also be ethoxylated materials that contain from about 2 to about 12 ethylene oxide moieties per molecule, more preferably from about 3 to about 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Suitable alkoxylated fatty alcohol nonionic surfactants have been marketed under the tradename NEODOL® by the Shell Chemical Company.

Another suitable type of nonionic surfactant useful herein comprises the amine oxide surfactants. Amine oxides are materials which are often referred to in the art as "semi-polar" nonionics. Amine oxides have the formula: $R^2(EO)_f(PO)_g(BO)_hN(O)(CH_2R^3)_2.qH_2O$. In this formula, $R^2$ is a relatively long-chain alkyl moiety which can be saturated or unsaturated, linear or branched, and can contain from 8 to 20, preferably from 10 to 16 carbon atoms, and is more preferably a $C_{12}$-$C_{16}$ primary alkyl. $R^3$ is a short-chain moiety, preferably selected from hydrogen, methyl and —$CH_2OH$. When f+g+h is different from 0, EO is ethyleneoxy, PO is propyleneneoxy and BO is butyleneoxy. Exemplary amine oxide surfactants may be illustrated by $C_{12}$-$C_{14}$ alkyldimethyl amine oxide.

Non-limiting examples of nonionic surfactants include: a) $C_{12}$-$C_{18}$ alkyl ethoxylates, such as, NEODOL® nonionic surfactants from Shell; b) $C_6$-$C_{12}$ alkyl phenol alkoxylates where the alkoxylate units are a mixture of ethyleneoxy and propyleneoxy units; c) $C_{12}$-$C_{18}$ alcohol and $C_6$-$C_{12}$ alkyl phenol condensates with ethylene oxide/propylene oxide block polymers such as PLURONIC® from BASF; d) $C_{14}$-$C_{22}$ mid-chain branched alcohols ("BA") as discussed in U.S. Pat. No. 6,150,322; e) $C_{14}$-$C_{22}$ mid-chain branched alkyl alkoxylates ("$BAE_z$"), where z is 1-30, as discussed in U.S. Pat. Nos. 6,153,577; 6,020,303; and 6,093,856; f) alkyl-polysaccharides as discussed in U.S. Pat. No. 4,565,647; specifically alkylpolyglycosides as discussed in U.S. Pat. Nos. 4,483,780 and 4,483,779; g) Polyhydroxy fatty acid amides as discussed in U.S. Pat. No. 5,332,528, WO 92/06162, WO 93/19146, WO 93/19038, and WO 94/09099; and h) ether capped poly (oxyalkylated) alcohol surfactants as discussed in U.S. Pat. No. 6,482,994 and WO 01/42408.

In certain aspects of the laundry detergent compositions herein, the detersive surfactant component may comprise combinations of anionic and nonionic surfactant materials. When this is the case, the weight ratio of anionic to nonionic will typically range from 10:90 to 90:10, more typically from 30:70 to 70:30.

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides and sulfo and hydroxy betaines, such as N-alkyl-N,N-dimethylammino-1-propane sulfonate where the alkyl group can be $C_8$ to $C_{18}$ and in certain aspects from $C_{10}$ to $C_{14}$.

Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of ampholytic surfactants.

Cationic surfactants are known in the art and non-limiting examples of these include quaternary ammonium surfactants, which can have up to 26 carbon atoms. Additional examples include a) alkoxylate quaternary ammonium ("AQA") surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042; 4,239,660; 4,260,529; and 6,022,844; and e) amino surfactants as discussed in U.S. Pat. No. 6,221,825 and WO 00/47708, such as amido propyldimethyl amine ("APA").

Nonlimiting examples of surfactant systems include the conventional $C_{11}$-$C_{18}$ alkyl benzene sulfonates ("LAS") and primary, branched-chain and random $C_{10}$-$C_{20}$ alkyl sulfates ("AS"), the $C_{10}$-$C_{18}$ secondary (2,3)-alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, in other s at least about 9, and M is a water-solubilizing cation, especially sodium, unsaturated sulfates such as oleyl sulfate, the $C_{10}$-$C_{18}$ alkyl alkoxy sulfates ("$AE_zS$"; especially EO 1-7 ethoxy sulfates), $C_{10}$-$C_{18}$ alkyl alkoxy carboxylates (especially the EO 1-5 ethoxycarboxylates), the $C_{10}$-$C_{18}$ glycerol ethers, the $C_{10}$-$C_{18}$ alkyl polyglycosides and their corresponding sulfated polyglycosides, and $C_{12}$-$C_{18}$ alpha-sulfonated fatty acid esters. If desired, the conventional nonionic and amphoteric surfactants such as the $C_{12}$-$C_{18}$ alkyl ethoxylates ("AE") including the narrow peaked alkyl ethoxylates and $C_6$-$C_{12}$ alkyl phenol alkoxylates (especially ethoxylates and mixed ethoxy/propoxyates), $C_{12}$-$C_{18}$ betaines and sulfobetaines ("sultaines"), $C_{10}$-$C_{18}$ amine oxides, and the like, can also be included in the surfactant system. The $C_{10}$-$C_{18}$ N-alkyl polyhydroxy fatty acid amides can also be used. See WO 92/06154. Other sugar-derived surfactants include the N-alkoxy polyhydroxy fatty acid amides, such as $C_{10}$-$C_{18}$ N-(3-methoxypropyl)glucamide. The N-propyl through N-hexyl $C_{12}$-$C_{18}$ glucamides can be used for low sudsing. $C_{10}$-$C_{20}$ conventional soaps may also be used. If high sudsing is desired, the branched-chain $C_{10}$-$C_{16}$ soaps may be used. Mixtures of anionic and nonionic surfactants are especially useful. Other conventional useful surfactants are listed in standard texts.

Other surfactants useful herein include branched surfactants, such as those disclosed in the U.S. Pat. No. 8,044,249, U.S. Pat. No. 7,994,369, US Patent Application No. 2012/0010423, US Patent Application No. 2011/0034363, US Patent Application No. 2012/0010432, and US Patent Application No. 2011/0166370.

Adjunct Materials

The non-limiting list of adjuncts illustrated hereinafter may be suitable for use in the detergent compositions and may be desirably incorporated in certain aspects, for example to assist or enhance performance, for treatment of the substrate to be cleaned, or to modify the aesthetics of the composition, as is the case with perfumes, colorants, dyes or the like. The total amount of such adjuncts may range from about 0.1% to about 50%, or from about 1% to about 30%, by weight of the detergent composition.

The precise nature of these additional components and levels of incorporation thereof will depend on the physical form of the composition and the nature of the operation for which it is to be used. Suitable adjunct materials include, but are not limited to, polymers, for example cationic polymers, builders, additional chelating agents, dye transfer inhibiting agents, dispersants, enzyme stabilizers, catalytic materials, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments. In addition to the disclosure below, suitable examples of such other adjuncts and levels of use are found in U.S. Pat. Nos. 5,576,282, 6,306,812 B1 and 6,326,348 B1.

Builders—The compositions of the present invention can comprise one or more detergent builders or builder systems. When present, the compositions will typically comprise at least about 1% builder, or from about 5% or 10% to about 80%, 50%, or 30% by weight, of said builder. Builders include, but are not limited to, $C_{10}$-$C_{22}$ fatty acids, citric acid, the alkali metal, ammonium and alkanolammonium salts of polyphosphates, alkali metal silicates, alkaline earth and alkali metal carbonates, aluminosilicate builders polycarboxylate compounds, ether hydroxy-polycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

In certain aspects, the detergent composition comprises a boric acid derivative. By "boric acid derivatives" it is meant boron containing compounds, such as boric acid per se, and other boric acid derivatives, at least a part of which are present in solution as boric acid or a chemical equivalent thereof. Illustrative examples of boric acid derivatives includes boric acid, MEA-borate, borax, boric oxide, tetraborate decahydrate, tetraborate pentahydrate, alkali metal borates (such as sodium ortho-, meta- and pyroborate and sodium pentaborate) and mixtures thereof.

Additional Chelating Agents—The detergent composition of the present invention may include one or more additional chelating agents. If a combination of chelants is used, the combination of chelants may be chosen by one skilled in the art to provide for heavy metal (e.g., ferric iron) sequestration without negatively impacting enzyme stability through the excessive binding of calcium ions.

Chelating agents suitable for use in the present invention include aminocarboxylates, aminophosphonates, hydroxyethanediphosphonates, succinates, salts thereof, and mixtures thereof. Non-limiting examples of suitable chelants for use herein include ethylenediaminetetracetates, N-(hydroxyethyl)ethylenediaminetriacetates, nitrilotriacetates, ethylenediamine tetraproprionates, triethylenetetraaminehexacetates, diethylenetriamine-pentaacetates, ethanoldiglycines, ethylenediamine disuccinate (EDDS), methylglycinediacetic acid (MGDA), diethylenetriaminepentaacetic acid (DTPA), salts thereof, and mixtures thereof.

Phosphorus containing chelants suitable for use in the present invention include diethylene triamine penta(methylene phosphonic acid) (DTPMP CAS 15827-60-8); ethylene diamine tetra(methylene phosphonic acid) (EDTMP CAS 1429-50-1); hexamethylene diamine tetra(methylene phosphonic acid) (CAS 56744-47-9); hydroxy-ethane diphosphonic acid (HEDP CAS 2809-21-4); hydroxyethane dimethylene phosphonic acid; 2-phosphono-1,2,4-Butanetricarboxylic acid (CAS 37971-36-1); 2-hydroxy-2-phosphono-Acetic acid (CAS 23783-26-8); Aminotri (methylenephosphonic acid) (ATMP CAS 6419-19-8); P,P'-(1,2-ethanediyl)bis-Phosphonic acid (CAS 6145-31-9); P,P'-methylenebis-Phosphonic acid (CAS 1984-15-2); Triethylenediaminetetra(methylene phosphonic acid) (CAS 28444-52-2); P-(1-hydroxy-1-methylethyl)-Phosphonic acid (CAS 4167-10-6); bis(hexamethylene triamine penta(methylenephosphonic acid)) (CAS 34690-00-1); N2,N2,N6,N6-tetrakis(phosphonomethyl)-Lysine (CAS 194933-56-7, CAS 172780-03-9), salts thereof, and mixtures thereof.

Other non-limiting examples of chelants of use in the present invention are found in U.S. Pat. Nos. 7,445,644, 7,585,376 and 2009/0176684A1. Other suitable chelating agents for use herein are the commercial DEQUEST series, and chelants from Monsanto, DuPont, and Nalco, Inc.

The additional chelant(s) may be present in the detergent compositions disclosed herein at from about 0.01% to about 5% by weight, or from about 0.2% to about 0.7% by weight, or from about 0.3% to about 0.6% by weight of the detergent compositions disclosed herein.

Suds modifiers—The compositions of the present invention may include one or more suds modifiers. Suds modifiers are described in U.S. Pat. Nos. 3,933,672 and 4,136,045.

Perfumes—Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes typically comprise from about 0.01% to about 2%, by weight, of the surface treatment compositions herein, and individual lay softeners can be used in combination with amine and cationic softeners perfumery ingredients can comprise from about 0.0001% to about 90% of a finished perfume composition. In one aspect, the compositions disclosed herein may comprise a perfume delivery system. Suitable perfume delivery systems, methods of making certain perfume delivery systems and the uses of such perfume delivery systems are disclosed in USPA 2007/0275866 A1. In one aspect, such perfume delivery system may be a perfume microcapsule. In one aspect, said perfume microcapsule may comprise a core that comprises perfume and a shell, said shell encapsulating said core. In one aspect, said shell may comprise a material selected from the group consisting of aminoplast copolymer, esp. melamine-formaldehyde or urea-formaldehyde or cross-linked melamine formaldehyde, an acrylic, an acrylate and mixtures thereof. In one aspect, said perfume microcapsule's shell may be coated with one or more materials, such as a polymer, that aids in the deposition and/or retention of the perfume microcapsule on the site that is treated with the composition disclosed herein. In one aspect said polymer may be a cationic polymer selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, poly vinyl amine, copolymers of poly vinyl amine and N-vinyl formamide and mixtures thereof. In one aspect, said perfume microcapsule may be friable and/or have a mean particle size of from about 10 microns to about 500 microns or from about 20 microns to 200 microns. In one aspect, said composition may comprise, based on total composition weight, from about 0.01% to about 80%, from about 0.1% to about 50%, from about 1.0% to about 25% or from about 1.0% to about 10% of said perfume microcapsules. Suitable capsules may be obtained from Appleton Papers Inc., of Appleton, Wis. USA. Formaldehyde scavengers may also be used in or with such perfume microcapsules.

Polymers—The detergent composition of the present invention may comprise polymers, such as grease cleaning polymers and soil suspending polymers. Non-limiting examples of grease cleaning and/or soil suspending polymers include alkoxylated polyalkylenemine polymers, examples of which may be found in U.S. Pat. No. 3,489,686, U.S. Pat. No. 5,565,145, WO 2006/108857, and the US publication of application Ser. No. 12/266,751.

Dye Transfer Inhibiting Agents—The compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or about 1% by weight of the cleaning compositions.

Dispersants—The compositions of the present invention can also contain dispersants. Suitable water-soluble organic materials are the homo- or co-polymeric acids or their salts, in which the polycarboxylic acid may comprise at least two carboxyl radicals separated from each other by not more than two carbon atoms.

Fabric Hueing Agents—The composition may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes such as those described in EP1794275 or EP1794276, or dyes as disclosed in U.S. Pat. No. 7,208,459 B2, and mixtures thereof. In another aspect, suitable small molecule dyes include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in WO2011/98355, WO2011/47987, US2012/090102, WO2010/145887, WO2006/055787 and WO2010/142503.

In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet Conn., carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, and mixtures thereof.

Preferred hueing dyes include the whitening agents found in WO 08/87497 A1, WO2011/011799 and WO2012/054835. Preferred hueing agents for use in the present invention may be the preferred dyes disclosed in these references, including those selected from Examples 1-42 in Table 5 of WO2011/011799. Other preferred dyes are disclosed in U.S. Pat. No. 8,138,222. Other preferred dyes are disclosed in WO2009/069077.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used).

Structurant—In some aspects of the present invention, the laundry detergent compositions further comprise a structurant. Structurants of use include those disclosed in U.S. Patent Nos. 2006/0205631A1, 2005/0203213A1, U.S. Pat. Nos. 7,294,611, and 6,855,680. U.S. Pat. No. 6,855,680 defines suitable hydroxyfunctional crystalline materials in detail. A suitable structurant is hydrogenated castor oil. Non-limiting examples of useful structurants include those selected from the group of: hydrogenated castor oil; derivatives of hydrogenated castor oil; microfibrillar cellulose; hydroxyfunctional crystalline materials, long-chain fatty alcohols, 12-hydroxystearic acid; clays; and mixtures thereof. In some aspects, low molecular weight organogellants can be used. Such materials are defined in: *Molecular Gels, Materials with Self-Assembled Fibrillar Networks*, Edited by Richard G. Weiss and Pierre Terech.

Pearlescent Agent—In some aspects of the present invention, the laundry detergent compositions further comprise a pearlescent agent. Pearlescent agents of use include those described in U.S. Patent No. 2008/0234165A1. Non-limiting examples of pearlescent agents may be selected from the group of: mica; titanium dioxide coated mica; bismuth oxychloride; fish scales; mono and diesters of alkylene glycol of the formula:

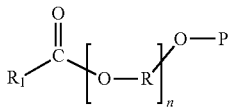

where:

a. $R_1$ is linear or branched C12-C22 alkyl group;

b. R is linear or branched C2-C4 alkylene group;

c. P is selected from the group of: H; C1-C4 alkyl; or —$COR_2$; and d. n=1-3.

In some aspects, R2 is equal to R1, such that the alkylene glycol is ethyleneglycoldistearate (EGDS).

pH

According to certain aspects of the detergent compositions disclosed herein, the pH of the detergent composition may have an effect on color formation and/or enzyme stability. According to one aspect, the detergent compositions may have a pH ranging from about 4.5 to about 10. In another aspect, the detergent composition may have a pH ranging from about 7 to about 9. In another aspect, the detergent composition may have a pH ranging from about 7.5 to about 8.5. In another aspect, the detergent composition may have a pH of about 8, or from about 8.0 to about 8.2.

C. Process of Measuring Color Formation

As disclosed herein, the 2-pyridinol-N-oxide compounds of the present invention do not produce an undesirable or incompatible colored complex with ferric iron in detergent compositions. The color associated with the introduction of a chelating agent, such as the compounds of the invention, into a detergent composition that contains ferric iron may be measured by any colorimetric or spectrometric method known in the art. Suitable colorimetric analytical methods include, for example, the Gardner color scale (according to American Society for Testing and Materials ("ASTM") method ASTM D1544, D6166 and/or American Oil Chemists' Society ("AOCS") method AOCS Td-1a-64); the Hunter L.a.b. (CIE) color scale (according to ASTM D5386-93b); the American Public Health Association ("APHA") color scale (according to ASTM D1209 or AOCS Td-1b-64); the Saybolt color scale (according to ASTM D156 or D6045); or the Lovibond (red) scale (according to AOCS Cc-13b-45). It should be noted that the present disclosure is not limited to any specific colorimetric measurement and the color observed in the various aspects of the detergent compositions may be measured by any suitable colorimetric method.

The formation of color may be measured, for example, using the spectrophotometric method, e.g., by measuring the absorbance of a specific wavelength of light by the detergent composition/ferric iron mixture. According to this spectrophotometric method, after all components of the detergent composition are combined, including low concentrations of ferric iron, and the color of the samples equilibrated, the detergent samples are diluted 1:10 by weight with water and analyzed on a Beckman Coulter DU 800 UV/Vis Spectrophotometer in 1 cm disposable cuvettes. The instrument is set to scan from 400-700 nm. Absorbance versus wavelength plots for each measurement are generated.

D. Process of Making Detergent Compositions

The detergent compositions of the present invention can be formulated into any suitable form and prepared by any process chosen by the formulator, non-limiting examples of which are described in U.S. Pat. Nos. 5,879,584; 5,691,297; 5,574,005; 5,569,645; 5,565,422; 5,516,448; 5,489,392; and 5,486,303.

In one aspect, the detergent compositions disclosed herein may be prepared by combining the components thereof in any convenient order and by mixing, e.g., agitating, the resulting component combination to form a phase stable liquid detergent composition. In one aspect, a liquid matrix is formed containing at least a major proportion, or even substantially all, of the liquid components, e.g., nonionic surfactant, the non-surface active liquid carriers and other optional liquid components, with the liquid components being thoroughly admixed by imparting shear agitation to this liquid combination. For example, rapid stirring with a mechanical stirrer may usefully be employed. While shear agitation is maintained, the 2-pyridinol-N-oxide compound and substantially all of any anionic surfactant and the solid ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills, are incorporated. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

E. Method of Using Detergent Compositions

The detergent compositions of the present disclosure may be used to clean, treat, and/or pretreat a fabric. Typically at least a portion of the fabric is contacted with the aforementioned detergent compositions, in neat form or diluted in a liquor, e.g., a wash liquor, and then the fabric may be optionally washed and/or rinsed. In one aspect, a fabric is optionally washed and/or rinsed, contacted with the aforementioned detergent compositions and then optionally washed and/or rinsed. In another aspect, the detergent composition is applied onto the soiled fabric and left to act on the fabric before the fabric is washed. The composition may remain in contact with the fabric until dry or for a longer period of time, or for a period of 1 minute to 24 hours, or 1 minute to 1 hour, or 5 minutes to 30 minutes. For purposes of the present invention, washing includes, but is not limited to, scrubbing, brushing, and mechanical agitation. Typically after washing and/or rinsing, the fabric is dried. The fabric may comprise most any fabric capable of being laundered or treated.

The detergent compositions of the present disclosure may be used to form aqueous washing solutions for use in the laundering of fabrics. Generally, an effective amount of such compositions is added to water, for example in a conventional fabric laundering automatic washing machine or by a hand washing method, to form such aqueous laundering solutions. The aqueous washing solution so formed is then contacted, sometimes under agitation, with the fabrics to be laundered therewith. An effective amount of the detergent composition, such as the HDL detergent compositions of the present disclosure, may be added to water to form aqueous laundering solutions that may comprise from about 200 to about 15,000 ppm or even from about 300 to about 7,000 pm of detergent composition.

The following representative examples are included for purposes of illustration and not limitation.

EXAMPLES

Liquid detergent compositions may be prepared by mixing together the ingredients listed in the proportions shown:

TABLE 1

| Component | A Wt % | B Wt % | C Wt % | D Wt % | E Wt % |
|---|---|---|---|---|---|
| C 12-15 alkyl polyethoxylate (1.8) sulfate | 17.3 | 14.7 | 16.4 | 17.3 | 17.3 |
| C 11.8 linear alkylbenzene sulfonic acid | 7.7 | 4.3 | 9.0 | 7.7 | 7.7 |
| C 16-17 branched alkyl sulfate | 3.3 | — | 1.8 | 3.3 | 3.3 |
| C 24 alkyl 9-ethoxylate | 1.5 | 1.0 | 1.3 | 1.4 | 1.4 |
| C12-14 alkyl dimethyl amine oxide | 1.0 | 0.6 | 1.0 | 0.8 | 0.8 |
| Citric acid | 0.7 | — | 0.7 | 3.5 | 3.5 |
| C12-18 Fatty Acid | 1.5 | 0.9 | 0.9 | 1.5 | 1.5 |
| Substituted or unsubstituted 2-pyridinol N-oxide compound or a tautomer thereof | 0.1 | 0.5 | 1 | 0.5 | 0.5 |
| DTPA | 0.3 | — | — | — | 0.3 |
| HEDP | — | 0.3 | — | — | — |
| DTPMP | — | — | — | 0.3 | — |
| Phenylboronic Acid | 0.1 | 0.04 | 0.01 | — | — |
| Boric Acid | — | — | — | 2 | — |
| Soil Suspending Alkoxylated Polyalkylenimine Polymer[1] | 1.4 | 1.4 | 1.5 | 1.4 | 1.4 |
| Grease Cleaning Alkoxylated Polyalkylenimine Polymer[2] | 1.9 | 1.9 | 1.9 | 1.3 | 1.3 |
| Fluorescent whitening agent | 0.3 | 0.3 | 0.2 | 0.2 | 0.2 |
| Calcium Formate | 0.10 | 0.05 | 0.09 | 0.09 | — |
| Protease (40.6 mg/g)[3] | 1.5 | 1.7 | 1.7 | 1.5 | — |
| Natalase 200L (29.26 mg/g)[4] | 0.34 | 0.34 | 0.34 | 0.34 | — |
| Mannaway 25L (25 mg/g)[4] | — | — | — | 0.32 | — |
| Whitezyme (20 mg/g)[4] | — | 0.065 | 0.06 | 0.06 | — |
| Pectate lyase active enzyme protein (Pectawash) | — | — | — | 0.01 | — |
| Lipase active enzyme protein (Lipolex) | — | — | — | 0.03 | — |
| Hydrogenated castor oil[5] | 0.12 | 0.10 | 0.12 | — | — |
| Hueing Dye | 0.05 | 0.02 | 0.02 | — | 0.02 |
| Ferric Iron, as impurity | 0.00002 | 0.00006 | 0.0001 | 0.0005 | 0.00006 |

TABLE 1-continued

| Component | A Wt % | B Wt % | C Wt % | D Wt % | E Wt % |
|---|---|---|---|---|---|
| Water, perfumes, dyes, buffers, neutralizers, stabilizers, suds suppressors, solvents, and other optional components | to 100% pH 8.1-8.5 | to 100% pH 8.1-8.5 | to 100% pH 8.1-8.5 | to 100% pH 8.1-8.5 | to 100% pH 8.1-8.5 |

[1]600 g/mol molecular weight polyethylenimine core with 20 ethoxylate groups per —NH. Available from BASF (Ludwigshafen, Germany).

[2]600 g/mol molecular weight polyethylenimine core with 24 ethoxylate groups per —NH and 16 propoxylate groups per —NH. Available from BASF (Ludwigshafen, Germany).

[3]Available from Genencor International, South San Francisco, CA.

[4]Available from Novozymes, Bagsvaerd, Denmark.

[5]Available under the tradename Thixcin ® R from Elementis Specialties, Highstown, NJ.

TABLE 2

| Component | F Wt % | G Wt % | H Wt % | I Wt % |
|---|---|---|---|---|
| C12-15 alkyl polyethoxylate (3.0) sulfate | 8.5 | — | 4 | 2.9 |
| C11.8 linear alkylbenzene sulfonc acid | 11.4 | 11 | 12 | 8.2 |
| C14-15 alkyl 7-ethoxylate | — | 7 | 2 | 4.9 |
| C12-14 alkyl 7-ethoxylate | 7.6 | 1 | 0.5 | 0.4 |
| C12-14 alkyl dimethyl amine oxide | — | 0.4 | — | — |
| C12-18 Fatty Acid | 9.5 | 2.7 | 0.8 | 3.4 |
| Citric acid | 2.8 | 3.3 | 2.3 | 3.5 |
| Protease (40.6 mg/g)[1] | 1.0 | 0.5 | 0.5 | — |
| Natalase 200L (29.26 mg/g)[2] | — | 0.1 | 0.1 | — |
| Termamyl Ultra (25.1 mg/g)[2] | 0.7 | 0.05 | 0.05 | — |
| Mannaway 25L (25 mg/g)[2] | 0.1 | 0.05 | 0.05 | — |
| Whitezyme (20 mg/g)[2] | 0.2 | 0.05 | 0.05 | — |
| Fluorescent Whitening Agent | 0.2 | 0.1 | 0.05 | 0.1 |
| Substituted or unsubstituted 2-pyridinol N-oxide compound or a tautomer thereof | 0.1 | 0.5 | 1 | 0.5 |
| DTPMP | 0.5 | 0.3 | — | — |
| HEDP | — | — | — | 0.30 |
| Phenylboronic Acid | 0.1 | 0.01 | — | — |
| Boric Acid | — | — | 2 | — |
| Soil Suspending Alkoxylated Polyalkylenimine Polymer[3] | — | — | 0.1 | — |
| Zwitterionic ethoxylated quaternized sulfated hexamethylene diamine[4] | 2.1 | 0.7 | 0.7 | 1.6 |
| Grease Cleaning Alkoxylated Polyalkylenimine Polymer[5] | — | — | 0.1 | 0.1 |
| PEG-PVAc Polymer[6] | 0.9 | 0.8 | 0.8 | 0.5 |
| Hydrogenated castor oil[7] | 0.8 | 0.4 | 0.4 | 0.4 |
| Ca Cl2 | — | 0.05 | 0.05 | — |
| Sodium Formate | — | 0.2 | 0.2 | — |
| Na Cumene Sulfonate | — | 1 | 1 | 1 |
| Hueing Dye | — | 0.03 | 0.03 | 0.03 |
| Ferric Iron, as impurity | 0.00002 | 0.00006 | 0.0001 | 0.0005 |
| Water, perfumes, dyes, buffers, neutralizers, stabilizers, suds suppressors and other optional components | to 100% pH 8.0-8.2 | to 100% pH 8.0-8.2 | to 100% pH 8.0-8.2 | to 100% pH 8.0-8.2 |

[1]Available from Genencor International, South San Francisco, CA.

[2]Available from Novozymes, Bagsvaerd, Denmark.

[3]600 g/mol molecular weight polyethylenimine core with 20 ethoxylate groups per —NH. Available from BASF (Ludwigshafen, Germany).

[4]Described in WO 01/05874 and available from BASF (Ludwigshafen, Germany).

[5]600 g/mol molecular weight polyethylenimine core with 24 ethoxylate groups per —NH and 16 propoxylate groups per —NH. Available from BASF (Ludwigshafen, Germany).

[6]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).

[7]Available under the tradename Thixcin ® R from Elementis Specialties, Highstown, NJ.

Test Data

Example 1

Detergent compositions in Table 3 below are created for testing.

TABLE 3

| Component | Percentage | | |
|---|---|---|---|
| | Product 1 | Product 2 | Product 3 |
| C 12-15 alkyl polyethoxylate (3) sulfate | 12 | 12 | 12 |
| C 14-15 alkyl 7-ethoxylate | 6 | 6 | 6 |
| C 12-13 alkyl 6.5-ethoxylate | 6 | 6 | 6 |
| 2-Pyridinol-1-Oxide | 0 | 0.5 | 0.5 |
| Hydrogen Peroxide | 0 | 0 | 6 |
| BHT | 0.05 | 0.05 | 0.05 |
| Water | Balance | Balance | Balance |

After all components are combined, the sample is homogenized with an overhead mixer. The pH of each detergent formulation is then adjusted to 8.3 using 1.0 M HCl and NaOH.

The Stain Removal Index (SRI) is measured using a modified version of the "Standard Guide for Evaluating Stain Removal Performance in Home Laundering" (ASTM D4265-98). The modifications include the following: at least 3 external replicates and at least 3 internal replicates are tested; the stain is applied by placing the fabric on a flat surface and applying the stain using a pipette for liquids or a brush for solids with a predetermined amount each time; modified artificial sebum and air filter dirt are not tested. The stains tested are supplied by EMC Empirical Manufacturing Company.

TABLE 4

| Tea Stain Removal Index | SRI Product 1 | Δ SRI Product 2 vs. Product 1 | Δ SRI Product 3 vs. Product 1 | Tukey's HSD |
|---|---|---|---|---|
| 5 Minute Pretreatment | 2.5 | 40.1 | 57.4 | 7.1 |
| 16 Hour Pretreatment | −23.5 | 54.7 | 116.9 | 12.3 |
| Though-the-Wash | 11.9 | 0.4 | 0.9 | 4.6 |

Delta SRI differences that exceed the error (Tukey's HSD) are statistically significant and are indicated in italics. A value of 0 on the SRI scale is equivalent to zero removal of the initial stain, while a value of 100 indicates complete removal. Values less than 0 indicate a darkening of the stain while values greater than 100 indicate fabric whiter than the unstained reference. The results in Table 4 show the impact of pretreatment with the detergent before washing. Surprisingly, pretreatment as short as five minutes with compositions that contain 2-pyridinol-1-oxide, such as Product 2, show significant benefits on tea stains (40-54 SRI), even in the absence of hydrogen peroxide.

Example 2

Detergent formulations based on Product 1 in Example 1 are created for testing. 0.5% by weight of 3-pyridinecarboxylic acid, 2-hydroxy-, 1-oxide, EDDS, DTPMP, and DTPA are added to the formulations, as described in Table 5. The pH of all detergent formulations are adjusted to that of Product 1. The determination of the SRI index and pretreatment testing are performed in a similar manner as Example 1. Washing takes place in a North American top loader with a 90° F. wash for 12 min followed by a 2-minute rinse at 60° F. with water of hardness 6 gpg.

TABLE 5

| 5 minute pretreatment Composition | SRI Product 1 | Δ SRI vs. Product 1 | | | | Tukey's HSD |
|---|---|---|---|---|---|---|
| | | Product 1 + 0.5% 3-Pyridine-carboxylic acid, 2-hydroxy-, 1-oxide | Product 1 + 0.5% EDDS | Product 1 + 0.5% DTPMP | Product 1 + 0.5% DTPA | |
| Tea Stain Removal Index | 15.9 | 28.5#* | 13.0# | 18.3# | 20.3# | 2.50 |

#Significant vs. Product 1

*Significant vs. EDDS, DTPMP and DTPA

For pretreatment, the stains are pretreated with a portion of the product that has been weighed out for through-the-wash testing. The stains are placed on a flat level surface. Using a Manostat Syringe, or equivalent, each stain is covered with 1 mL of product. The product is spread lightly to cover the entire stain and is not be rubbed into the stain. After all the stains have been pretreated, the stains are allowed to sit flat for either 5 minutes or 16 hours, as indicated. The stain order of pretreat should be maintained across all products. The portion of the product that has been weighed out for through-the-wash testing is added directly to the washing machine. Washing takes place in a North American top loader with a 90° F. wash for 12 min followed by a 2-minute rinse at 60° F. with water of hardness 6 gpg. Fabrics are dried with an automatic dryer until dry before SRI measurements are taken.

Delta SRI differences that exceed the error (Tukey's HSD) are statistically significant and are indicated in italics. The results in Table 5 show the impact of pretreatment with the detergent before washing. The results show that a five-minute pretreatment with the compositions tested yields significant benefits vs. Product 1, which does not contain chelant. Surprisingly, 3-pyridinecarboxylic acid, 2-hydroxy-, 1-oxide shows significant benefits versus the other chelants tested.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular aspects of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising:

a. at least about 0.2 ppm of ferric iron;

b. from about 0.05% by weight to about 2% by weight of a substituted or unsubstituted 2-pyridinol N-oxide compound, a tautomer thereof, or a salt thereof; and from about 5% by weight to about 90% by weight of a surfactant selected from the group consisting of an anionic surfactant, a nonionic surfactant, a zwitterionic surfactant, amine oxide, and mixtures thereof;

wherein the detergent composition is free of bleach, and further wherein a mole ratio of said substituted or unsubstituted pyridinol-N-oxide compound to said ferric iron is at least about 3:1.

2. The detergent composition of claim 1 wherein said substituted or unsubstituted 2-pyridinol N-oxide compound comprises the following structure:

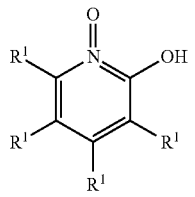

wherein each $R^1$ is independently selected from the group consisting of

H, Cl, Br, I, F, NO, $NO_2$, $(CH_2)_nG$, and mixtures thereof, wherein each G is independently selected from the group consisting of $(O)_mSO_3M$, $(O)_mCO_2M$, $(O)_mC(O)(R^2)$, $(O)_mC(O)N(R^2)_2$, $(O)_mCN$, $(O)_m(R^2)$, $N(R^2)_2$, and mixtures thereof, wherein each m is 0 or 1, each n is an integer from 0 to 4, each $R^2$ is independently selected from the group consisting of H and a substituted or unsubstituted $C_1$-$C_{12}$ organic group, and each M is independently selected from the group consisting of $R^2$, wherein $R^2$ is defined as above, $N^+(R^2)_4$, and $1/q\ M'\ q^+$ wherein M' is selected from the group consisting of an alkali metal of charge q and an alkaline earth metal of charge q, and wherein any two vicinal $R^1$ may be taken together to form another five- or six-membered aromatic or aliphatic ring optionally substituted with one or more groups selected from the group consisting of Cl, Br, I, F, NO, $NO_2$, CN, $(CH_2)_nG$, and mixtures thereof.

3. The detergent composition of claim 2, wherein each $R^1$ is independently selected from the group consisting of H, Cl, and $(CH_2)_nG$, wherein G is independently selected from the group consisting of $(O)_mSO_3M$, $(O)_mCO_2M$, $(O)_mC(O)(R^2)$, $(O)_mCN$, and $(O)_m(R^2)$, wherein each m is 0 or 1.

4. The detergent composition of claim 2, wherein each $R^1$ is independently selected from the group consisting of H, $SO_3M$, and $CO_2M$ and wherein no more than one $R^1$ is $SO_3M$ or $CO_2M$.

5. The detergent composition of claim 1, wherein said substituted or unsubstituted 2-pyridinol-N-oxide compound has a molecular weight of less than about 400 daltons.

6. The detergent composition of claim 1, wherein said composition comprises from about 0.15% by weight to about 0.5% by weight of said substituted or unsubstituted 2-pyridinol-N-oxide compound.

7. The detergent composition of claim 1, wherein said composition comprises from about 5% to about 70% by weight surfactant.

8. The detergent composition of claim 7, wherein said composition comprises a mixture of anionic surfactant and nonionic surfactant, wherein the weight ratio of anionic surfactant to nonionic surfactant is from about 10:90 to about 90:10.

9. The detergent composition of claim 8, wherein the weight ratio of anionic surfactant to nonionic surfactant comprising said detergent composition ranges from about 30:70 to about 70:30.

10. The detergent composition of claim 1, wherein said composition further comprises a component selected from the group consisting of polymers, builders, additional chelating agents, dye transfer inhibiting agents, dispersants, enzymes, enzyme stabilizers, catalytic materials, polymeric dispersing agents, clay soil removal agents, anti-redeposition agents, brighteners, hueing agents, suds suppressors, dyes, perfume, perfume delivery systems, structurant, carriers, hydrotropes, processing aids, pigments, and mixtures thereof.

11. The detergent composition of claim 10, wherein said composition comprises a phosphonate chelating agent.

12. A method of treating a stained fabric comprising the step of applying the detergent composition of claim 1 to a stained portion of said fabric.

13. A detergent composition comprising:

a. at least about 0.2 ppm of ferric iron;

b. from about 0.05% by weight to about 2% by weight of a compound selected from the group consisting of: 2-hydroxypyridine-1-oxide; 3-pyridinecarboxylic acid, 2-hydroxy-, 1-oxide; 6-hydroxy-3-pyridinecarboxylic acid, 1-oxide; 2-hydroxy-4-pyridinecarboxylic acid, 1-oxide; 2-pyridinecarboxylic acid, 6-hydroxy-, 1-oxide; 6-hydroxy-3-pyridinesulfonic acid, 1-oxide; a tautomer thereof; a salt thereof; and mixtures thereof; and from about 5% by weight to about 90% by weight of a surfactant selected from the group consisting of an anionic surfactant, a nonionic surfactant, a zwitterionic surfactant, amine oxide, and mixtures thereof;

wherein the detergent composition is free of bleach, and further wherein a mole ratio of said compound to said ferric iron is at least about 3:1.

14. A detergent composition comprising:

a. at least about 0.2 ppm of ferric iron;

b. from about 0.05% by weight to about 2% by weight of a compound selected from the group consisting of: 1-Hydroxy-2(1H)-pyridinone; 1,6-dihydro-1-hydroxy-6-oxo-3-Pyridinecarboxylic acid; 1,2-dihydro-1-hydroxy-2-oxo-4-Pyridinecarboxylic acid; 1,6-dihydro-1-hydroxy-6-oxo-2-Pyridinecarboxylic acid; 1-hydroxy-4-methyl-6-(2,4,4-trimethylpentyl)-2(1H)-Pyridinone; 6-(cyclohexylmethyl)-1-hydroxy-4-methyl-2(1H)-Pyridinone; 1-hydroxy-4,6-dimethyl-2(1H)-Pyridinone; 1-Hydroxy-4-methyl-6-(2,4,4-trimethylpentyl)-2-pyridone monoethanolamine; 1-hydroxy-6-(octyloxy)-2(1H)-Pyridinone; 1-Hydroxy-4-methyl-6-cyclohexyl-2-pyridinone ethanolamine salt; 1-Hydroxy-4-methyl-6-cyclohexyl-2-pyridinone; 6-ethoxy-1,2-dihydro-1-hydroxy-2-oxo-4-Pyridinecarboxylic acid,methyl ester; 1-hydroxy-5-nitro-2(1H)-Pyridinone; a tautomer thereof; a salt thereof; and mixtures thereof; and from about 5% by weight to about 90% by weight of a surfactant selected from the group consisting of an anionic surfactant, a nonionic surfactant, a zwitterionic surfactant, amine oxide, and mixtures thereof;

wherein the detergent composition is free of bleach, and further wherein a mole ratio of said compound to said ferric iron is at least about 3:1.

* * * * *